United States Patent [19]

Kasai et al.

[11] Patent Number: 4,746,590

[45] Date of Patent: May 24, 1988

[54] PROCESS FOR PRODUCING TONERS FOR USE IN ELECTROPHOTOGRAPHY

[75] Inventors: Hideaki Kasai, Tatsuno; Mitsugu Fujioka, Toyonaka, both of Japan

[73] Assignees: Nagase Chemicals, Ltd.; Nagase & Company, Ltd., both of Osaka, Japan

[21] Appl. No.: 945,553

[22] Filed: Dec. 23, 1986

[30] Foreign Application Priority Data

Dec. 23, 1985 [JP] Japan ..... 60-291771
May 24, 1986 [JP] Japan ..... 61-119598

[51] Int. Cl.[4] ..... G03G 9/08
[52] U.S. Cl. ..... 430/137
[58] Field of Search ..... 430/110, 137, 109

[56] References Cited

U.S. PATENT DOCUMENTS

| | | | |
|---|---|---|---|
| 3,502,582 | 3/1970 | Clemens et al. | 430/137 |
| 3,669,922 | 6/1972 | Bartsch et al. | 430/137 |
| 3,770,692 | 11/1973 | Miller | 430/137 |
| 4,016,099 | 4/1977 | Wellman et al. | 252/316 |
| 4,623,604 | 11/1986 | Takagiwa et al. | 430/109 |
| 4,652,509 | 3/1987 | Shirose et al. | 430/110 |

FOREIGN PATENT DOCUMENTS

| | | |
|---|---|---|
| 2649940 | 5/1977 | Fed. Rep. of Germany . |
| 1419125 | 12/1975 | United Kingdom . |
| 2045812 | 11/1980 | United Kingdom . |

*Primary Examiner*—John L. Goodrow
*Attorney, Agent, or Firm*—Wenderoth, Lind & Ponack

[57] ABSTRACT

A process for producing toners for use in electrophotography which comprises: dyeing resin particles which have a predetermined particle size with a dye in an aqueous medium in such amounts that the weight ratio of the medium to the resin particle is not less than about 5 in the presence of silica powder in an amount of up to 10 wt. % based on the weight of the resin at temperatures of not less than the softening point of the resin but not more than temperatures higher than the softening point about 40° C. under vigorous stirring. Water-insoluble dyes are particularly preferred.

The resultant toner is composed of particles of resin dyed fast and deeply, and is usable as it is as toners in electrophotography without further coloring of the particle.

10 Claims, No Drawings

PROCESS FOR PRODUCING TONERS FOR USE IN ELECTROPHOTOGRAPHY

This invention relates to a process for producing toners for developing latent electrostatic images in electrophotography.

In electrophotography using plain paper as a recording sheet, latent electrostatic images are formed on a photoconductive drum, dry-developed to visible toner images with toners on the drum, and then the toner image is transferred from the drum onto plain paper usually by corona discharge, and is thermally fused to be fixed thereon to visible images. Two developing methods are known, one which uses a developer composed of two components of carrier particles and toner particles, and the other which uses toner particles only.

The toner used in the former method has been heretofore produced by kneading thermoplastic resin particles with pigments such as carbon black, electric charge controlling agents and other additives by use of a ball mill or roll mill, and the resultant mixture is crushed by a hammer mill or vibration mill. The resultant powder is then made spherical and surface-treated to decrease electric resistance on the surface of the powder, or to prevent blocking of powders, and mixed with additives. The powder, however, has a broad particle size distribution, and consequently the powder is classified so that the toner has a particle size usually of 5–20 μm.

Therefore this prior process includes many steps, but also much intermediate product is lost in the classification, so that the yield of toners in the prior process is small and the production cost is high.

Therefore a process has been recently proposed to produce toners by coloring resin particles. For instance, Japanese Patent Laid-Open No. 56-154738 discloses a process in which suspension polymerization of monomers is carried out in the presence of carbon black to first provide colored core particles of polymers, which are thereafter dyed to form toners. According to this prior process, for example, styrene, n-butyl acrylate and diethylaminoethyl methacrylate are suspension polymerized in the presence of carbon black and colloidal silica under stirring and heating, to provide an aqueous suspension of colored core particles. However, since carbon black acts as a polymerization inhibitor in the polymerization, as well known, but also carbon black is very voluminous, the suspension polymerization in the presence of carbon black is difficult. It is also difficult to provide colored core particles of polymers which have uniform size distribution in the presence of carbon black.

According to the above prior process, the aqueous suspension is then heated and the core particle is dyed by use of water-soluble dyes to enhance the darkness of the core particle, and the core particle is further coated with a resin so that the core particle has surface properties desired as toners. There fore, the process also needs many steps.

It is, therefore, an object of the invention to provide a process for producing toners by directly dyeing resin particles to colored toners for use in electrophotography in high yields.

The process of the invention for producing toners for use in electrophotography comprises: dyeing resin particles which have a predetermined particle size with a dye in an aqueous medium in such amounts that the weight ratio of the medium to the resin particle of not less than about 5 at temperatures of not less than the softening point of the resin but not more than temperatures higher than the softening point by 40° C. under vigorous stirring.

The resin particle usable in the invention is particles of resins which are hydrophobic to an aqueous dyeing medium used so that the resin particle may not adhere to each other but remains particulate in the aqueous medium at temperatures not less than the softening point of the resin when the resin particle is dyed. The aqueous dyeing medium used in the invention is water which may contain small amounts of organic solvents, if desired, as will be described hereinafter. Therefore, the resin usable in the invention includes, for example, polyethylene, polystyrene, copolymers of styrene and one or more of acrylic monomers such as acrylic acid ester, methacrylic acid ester, acrylonitrile or methacrylonitrile, homopolymers of acrylic monomers, copolymers of acrylic monomers, ethylene-vinyl acetate copolymers, polyamide resins, polyester resins, polyvinyl butyral resins, epoxy resins, phenol resins, and mixtures of two or more of these. The resin may be in part cross-linked.

The resin has preferably softening points of about 50°–80° C., which are usually corresponding to glass transition temperatures of about 60°–120° C., and further has electric resistances of not less than about $10^{12}\Omega\cdot$cm, preferably not less than about $10^{13}\Omega\cdot$cm.

In the process of the invention, the resin particle used has a predetermined particle size or average particle size. Preferably the resin particle has an average particle size of about 5–20 μm, most preferably about 5–10 μm, and in particular, it is preferred that the particle size is in the range of about 5–20 μm. When the resin particle is larger than about 20 μm in average particle size, the resultant toner fails to form highly resolved fixed toner images, whereas when the resin particle is smaller than about 5 μm in average particle size, the resultant toner forms blotted images. The resin particle used in the invention, therefore, is preferably so classified or powdered, prior to the dyeing, as to have the average particle size or particle size as above mentioned when the resin particle has not the above specified particle size. However, the resin particle which has the predetermined particle size as above may also be directly produced by suspension polymerization of suitable monomers by controlling the polymerization conditions.

According to the invention, the resin particle which has the predetermined average particle size or particle size as described above is dispersed in an aqueous medium and directly dyed with a dye at a predetermined temperature under vigorous stirring. Water is preferably used as the dyeing medium, but when a resin particle is hydrophobic to water which contains small amounts of organic solvents which will be described hereinafter, then such an aqueous medium may also be usable as the dyeing medium in the dyeing of the resin particle.

In the invention, in general, water-insoluble dyes such as disperse dyes, metal complexed dyes, vat dyes or oil-soluble dyes are applicable to almost all kinds of resins, but watersoluble dyes such as acidic dyes, cationic or basic dyes, metal complexed dyes or reactive dyes are only applicable to limited resin particles. However, it is preferred that, if a water-insoluble dye is used, a dye is so selected that it has an affinity as much as possible for the resin particle used, and readily and fast dyes the resin particle, and a dye used is selected usually based on the chemical composition of the resin particle.

By way of example, disperse dyes are preferably used for polystyrene; disperse dyes, acidic dyes and cationic dyes for styrene-acrylic acid ester coplymers, styrene-acrylonitrile copolymers, polyacrylic acid esters or polymethacrylic acid esters; acidic dyes, metallized dyes, cationic dyes, reactive dyes and vat dyes for polyamide resins; disperse dyes and vat dyes for polyester resins; disperse dyes for polyvinyl butyral resins or epoxy resins. However, the disperse dyes and oil soluble dyes which are water-insoluble are most preferred in the process of the invention, and it is surprising that such water-insoluble dyes readily and fast dye the resin particle in deep colors according to the invention. A dyeing assistant may be used, if necessary. The dye is used usually in amounts of not less than about 2% by weight, preferably not less than about 4% by weight, based on the weight of the resin particle.

It is useful to use such finely divided dye particles as have particle sizes of not more than about 5 μm, preferably not more than about 2 μm since they readily and fast dye the resin particle very deeply. Such fine particles of dyes may be obtained, for example, by ball-milling or sand-milling.

On the other hand, polystyrene, styrene-acrylic acid ester copolymers and styrene-acrylonitrile copolymers particles are particularly preferred as the resin particle in the invention, since they are readily avilable on the market, but also they are readily and fast dyed especially by the disperse dye to provide toners which have satisfactory deep colors of values of 1.2–1.7 in the Macbeth chromaticity diagram.

According to the invention, the aqueous medium in which the resin particle is dyed is maintained at temperatures of not less than about the softening point of the resin but not more than temperatures higher than the softening point of the resin by 40° C. When the temperature of the aqueous medium is lower than the softening point of the resin, it is difficult to dye the resin particle deeply so as to be usable as toners, and if possible, it takes too much time for industrial production of toners. When the temperature of dyeing medium is higher than the softening point of the resin by 40° C. or more, the resin particle adheres to each other during the dyeing to form aggregates even though the particle is vigorously stirred in the dyeing.

Further according to the invention, the aqueous medium is used in such amounts that the weight ratio of the medium to the resin particle of not less than about 5, preferably in the range of 8–40. When the weight ratio of the medium to the resin particle is smaller than about 5, the resin particle has a tendency to adhere to each other to form aggregates even under vigorous stirring in the dyeing, since the medium is maintained at temperatures of not less than about the softening point of the resin. The aqueous medium may be used in a large excess, for example, in the weight ratio of the medium to the resin particle of about up to 100.

The dyeing may be carried out in the presence of additives known in the production of prior toners, when necessary, such as electric charge controlling agents, fluidizing agents or triiron tetroxide powders. Therefore, the charge controlling agent includes, for example, anhydrous silica powder, clay, talc, calcium carbonate and metallized complexes such as nigrosine, and the fluidizing agent includes, for example, metal soaps and anhydrous silica powder. The silica powder, as mentioned above, has both the functions of electric charge controlling agent and the fluidizing agent, and moreover the silica effectively prevents the aggregation of resin particle during the dyeing. Therefore, silica is a preferably used additive in the invention also. However, the silica is not dyed because of its hydrophobic surface.

In connection with the silica as an additive, anhydrous silica powder is used mainly as a fluidizing agent in prior processes for the production of toners, however, the amount of silica is usually so controlled as to be not more than about 1% by weight of toners, since the incorporation of silica in amounts of more than about 1% by weight makes the electric charge of the toner too large for use in ordinary electrophotography. That is, the amount of silica in conventional toners is insufficient to provide toners with a high fluidity. Meanwhile, since a resin is usually an insulator, the smaller the resin particle is, the larger the electric charge of the particle becomes, either positive or negastive, and hence the incorporation of charge controlling agent into fine toner particles is unavoidably necessary.

According to the invention, silica may be incorporated into resin particles in amounts about 10% by weight at the maximum based on the resin particle, so that the electric charge of toners generated by friction between the resin particle and iron powders when being mixed and stirred are controlled as desired in the range between −10 μC./mg and −100 μC./mg of toners when measured by use of "Blow-Off" type measuring apparatus (Toshiba Chemicals K.K., Japan). The incorporation of silica in amounts of about 3% by weight provides the toner with a high fluidity.

The dyeing may be carried out also in the presence of carbon black in the invention. Carbon black also acts both as the charge electric controlling agent and the fluidizing agent, but also deepens the color of the resin particle or strengthen the hiding power of the resultant toner.

The resin particle, after the dyeing, is separated from the aqueous dyeing medium, dried, and if necessary, powdered or classified, to provide toners of the invention. The method of the separation and drying of the dyed resin particle is not specifically limited, but any method known in powder technology is adoptable. By way of example, after the dyeing, the resin particle is separated by filtration from the dyeing medium and dried at room temperatures under normal pressures or at elevated temperatures under a reduced pressures. The additive may be mixed with the resin particle after dyeing thereof.

In the process of the invention, since the resin particle used has a predetermined particle size, preferably a particle size of 5–20 μm, before the dyeing, and there takes place substantially no adhesion of resin particle to each other during the dyeing, the resultant dyed particle substantially retains the same particle size as that of the particle before the dyeing. Accordingly neither powdering nor classification of the particle after the dyeing is usually needed. If the resin particle happens to adhere to each other during the dyeing, the aggregation to only a slight degree occurs since the particle is vigorously stirred in a large volume of the dyeing medium, so that only a light powdering is sufficient, if necessary, in the invention. Furthermore, even if the resin particle is classified after the dyeing, only a small amount of the toner is lost by the classification, and thus the process of the invention makes it possible to produce toners in much higher yields than in prior processes.

According to the invention, when the dyeing of the resin particle is carried out in the presence of silica powder, it is especially preferred that the resin particle and the silica powder are mixed with a small amount of the organic solvents as mentioned hereinbefore, to provide a wetted mixture of the resin particle and silica powder, and thereafter the wetted mixture is added to a dyeing medium. This wetting may be carried out, for example, by mixing, shaking or kneading the resin particle and silica powder together with the wetting solvent intimately and uniformly with rolls, paint shaker, kneader, and the like, although the means for forming the wetted mixture is not specifically limited.

A variety of organic solvents are usable as the wetting solvent, which include a lower aliphatic alcohol such as methanol, ethanol or isopropanol, a lower aliphatic carboxylic acid such as acetic acid or propionic acid, a lower alkyl ester of a lower aliphatic carboxylic acid such as methyl acetate, ethyl acetate, an aliphatic or alicyclic ether such as tetrahydrofuran, dioxane or diisopropyl ether, and a dialkyl ketone such as acetone or methyl ethyl ketone. The wetting solvent has preferably an affinity both for the resin particle and dye used as well as soluble in water, and is further preferably volatile at relatively low temperatures. Therefore, methanol is particularly preferred as the wetting solvent. The wetting solvent is used in such amounts as to form an intimate wet mixture of the resin particle and silica powder, and is usually in amounts of about 100–400 ml in relation to 100 g of the resin particle.

It is also preferred that the dye as well as the resin particle and silica powder are mixed and wetted together with a small amount of the wetting solvent, and thereafter the wetted mixture is added to an aqueous dyeing medium. If no silica powder is used, it is still preferred that the resin particle and powders of dye are mixed together and wetted with the wetting solvent to form a wetted mixture, which is then added to the dyeing medium. The resin particle is more readily and fast dyed in deeper colors when being wetted as above before the dyeing in the aqueous dyeing medium.

The reason why the formation of the wetted mixture of the resin particle and silica powder (and dye powder) makes the dyeing of the resin particle easy is not yet clear, but it is likely that the wetting solvent, for instance, methanol, adheres to or is adsorbed onto the surface of the resin particle so that the dye particle is readily put into contact with or adsorbed onto the surface of the resin particle. It is also likely that the dye particle is finely divided when being wetted together with the resin particle. The use of finely divided powder of dye particle of not more than about 5 μm, preferably not more than about 2 μm as mentioned before, is therefore also preferred when the dye is not wetted together with the resin particle (and silica powder).

As set forth above, the resin particle small and uniform in particle size are directly dyed with a dye in an aqueous medium at temperatures of not less than the softening point of the resin under vigorous stirring, to provide directly colored toners, according to the invention, contrary to prior processes in which many steps are needed. Furthermore, the resultant dyed particle substantially retains the same particle size as before the dyeing, there is usually no need of powdering or classification of the dyed particle, and if the aggregation of the particle takes place during the dyeing, a light powdering and classification provide toners in high yields.

Further according to the invention, if the resin particle is irregular in form, the resin particle is hydrophobic and heated as well as stirred in the dyeing medium as mentioned before, the particle is prevented from forming aggregates on account of heat and mechanical shearing applied to the particle during the dyeing in the aqueous dyeing medium, thereby to form almost spherical toner particles having a smooth surface.

The resultant toner composed of the dyed resin particle is usable, as is, for toners, without additional coloring, in electrophotoraphy, to produce fixed images which are deep and vivid in color, and clear in tones without contamination of recording sheets. In particular, when the dyeing is carried out in the presence of silica powder, the resultant toner has a desired particle distribution and electric charge as well as a high fluidity. When fixed images are formed on transparent film, the image is colored but transparent, and therefore, such film as has images fixed thereon with the toner of the invention being usable as a projecting film.

The invention will be more easily understood with reference to the following examples, which however are intended to illustrate the invention only and are not to be construed as limiting the scope of the invention.

EXAMPLE 1

An amount of 50 g of ppolystyrene particles of about 10 μm in average particle size having a softening point of about 45° C. and a glass transition temperature of 75° C. produced by suspension polymerization (MPS 1275 by Sumitomo Kagaku Kogyo K.K., Japan) was dispersed in 500 ml of water. An amount of 10 g of a black disperse dye Kayalon Polyester Black S conc. ( Nippon Kayaku K.K., Japan) was dispersed in 100 ml of water, and was added to the above resin particle dispersion.

The resultant dispersion was vigorously stirred with a magnetic stirrer while the dyeing medium was heated to 75° C. at a rate of 2° C./min., and was maintained at the temperature for 1 hour. After cooling, the resin particle was filtered with a No. 5 filter paper, washed with distilled water, and dried over calcium sulfate at room temperatures under normal pressure for 2 days. The dyed resin particle was then screened with a 200 mesh screen, to provide toners of about 10 μm in average particle size.

Using the toner combined with carrier powders as a developer, electrophotographic images were fixed on plain paper by use of an electrophotographic machine on market, to provide highly resolved fixed images clear in tones together with nonimage area with no contamination. The fixed image was found to have a color darkness of 1.5 according to the facsimile chart No. 1 (Electroimage Society, Japan) and mark 10 grade on a scale of 15 grades in tone presentation.

REFERENCE EXAMPLE 1

The same polystyrene particle as used in Example 1 was dyed in water at 90° C. and otherwise the same in Example 1, but toner particles were not obtained since the particle adhered to each other to form aggregates during the dyeing.

REFERENCE EXAMPLE 2

The same polystyrene particle as used in Example 1 was dyed by use of a water-soluble metal complexed black dye Kayakalan Black 2RL in water and otherwise the same in Example 1, but the resin particle was found little dyed.

EXAMPLE 2

An amount of 50 g of styrene-acrylic acid ester copolymer particles crushed and classified so as to have a particle size of 5–20 μm having a softening point of about 50° C. and a glass transition temperature of 64° C. (FB 206 by Mitsubishi Rayon K.K., Japan) was dispersed in 500 ml of water.

An amount of 10 g of a black disperse dye Kayalon Polyester Black EX-SF 200 (Nippon Kayaku K.K., Japan) was dispersed in 100 ml of water together with 1.5 g of anhydrous silica of 15–20 μm in particle size (Aerosil by Degussa, West Germany) as a charge controlling agent and a fluidizing agent wetted with 10 ml of methanol, and the dispersion was added to the above aqueous dispersion of the resin particle.

The resultant dispersion was heated to 88° C. at a rate of 2° C./min. in a rolling vibration dyeing apparatus, and was maintained at the temperature for 1 hour. During the dyeing slight aggregation of resin particle was observed. After cooling, the resin particle was filtered with a No. 5 filter paper, washed with distilled water, and dried for 2 days over calcium sulfate at room temperatures under normal pressure. The dyed resin particle was then screened with a 200 mesh screen, to provide toners of 5–20 μm in particle size. The toner was found to have an electric charge of −30 μC./mg when measured by use of "Blow-Off Type" measuring apparatus as referred hereinbefore.

The toner formed electrophotographic images fixed on plain paper highly resolved and clear in tones together with nonimage area with no contamination. The fixed image was found to have a color darkness of 1.3, and mark 10 grades of 15 grade on a scale in tone presentation.

EXAMPLE 3

An aqueous dispersion of 10 g of a blue disperse dye Kayalon Polyester Blue TS (Nippon Kayaku K.K., Japan) dispersed in 100 ml of water was added to an aqueous dispersion of 50 g of the same styrene-acrylic acid ester copolymer particles as used in Example 2 in 500 ml of water.

The resultant dispersion was heated to 90° C. at a rate of 2° C./min. in a mixer with vigorous stirring, and was maintained at the temperature for 1 hour. No aggregation of resin particles took place during the dyeing. After cooling, the resin particle was filtered with a No. 5 filter paper, washed with distilled water, and dried for 2 days over calcium sulfate at room temperatures under normal pressures, to provide toners of 5–20 μm in particle size which was found substantially spherical.

The toner formed electrophotographic images fixed on plain paper highly resolved and clear in tones together with nonimage area with no contamination. The fixed image was found to have a color darkness of 1.3, and mark 7 grade on a scale of 15 grades in tone presentation. The resolution was found to be 10 lines per mm.

EXAMPLE 4

An amount of 50 g of the same styrene-acrylic acid ester copolymer particles as used in Example 2 and 1 g of the same silica powder as used in Example 2 were mixed with 100 ml of methanol in a shaker, and the thus wetted mixture was dispersed in 500 ml of water. Then an aqueous dispersion of 4 g of a red disperse dye Diacelliton Fast Red 2B (by Mitsubishi Kasei Kogyo K.K., Japan) in 100 ml of water was added to the above dispersion.

The resultant dispersion was heated to 80° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and classified to particles of 5–20 μm in particle size. The resultant toner was found to have an electric charge of −93 ° C./mg.

The toner formed electrophotographic images fixed on plain paper highly resolved and clear in tones together with nonimage area with no contamination. The fixed image was found to have a color darkness of 1.5 and mark 12 grade on a scale of 15 grades in tone presentation.

EXAMPLE 5

An amount of 50 g of polyester resin particles having a softening point of about 60° C. and 1 g of the same silica as used in Example 2 was mixed with 100 ml of methanol in a shaker, and the thus wetted mixture was further shaken together with 2.5 g of solution of 1.0 g of finely divided powders of not more than about 2 μm in particle size of a red disperse dye Diacelliton Fast Scarlet B (by Mitsubishi Kasei Kogyo K.K., Japan) for 10 min. Then the resultant mixture was added to 500 ml of water.

The resultant dispersion was heated to 85° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and classified to particles of 5–20 μm in particle size. The toner was found to have an electric charge of −23 μC./mg.

The toner formed electrophotographic images fixed on plain paper highly resolved and clear in tones together with nonimage area with no contamination. The fixed image was found to have a color darkness of 1.7 and mark 13 grades of 15 grades in tone presentation.

EXAMPLE 6

An amount of 50 g of particles of polyamide (811-XP-80 by K.K. Toray, Japan) having a softening point of 64° C. and 1 g of the same silica powder as used in Example 2 was mixed with 100 ml of methanol in a shaker, and the thus wetted mixture was dispersed in 500 ml of water. Then an aqueous solution of 2 g of an acidic dye Kayanol Red NBR (by Nippon Kayaku K.K., Japan) in 100 ml of water was added to the above dispersion of resin particle and silica powder.

The resultant dispersion was heated to 80° C. at a rate of 2° C./min. in a mixer with vigorous stirring, and was maintained at the temperature for 1 hour. After cooling, the resin particle was filtered with a No. 5 filter paper, washed with distilled water, dried at 60° C. under a reduced pressure for 24 hours, and classified to particles of 5–20 μm in particle size. The toner was found to have an electric charge of −10 μC./mg.

The toner formed electrophotographic images fixed on plain paper highly resolved and clear in tones together with nonimage area with no contamination. The fixed image was found to have a color darkness of 1.3 and mark 8 grade on a scale of 15 grades in tone presentation.

EXAMPLE 7

An amount of 50 g of the same polyamide particles as used in Example 6 and 1 g of the same silica powder as used in Example 2 and 2.5 g of a water-insoluble metal complexed dye Erionyl Black B Liquid (Chiba-Geigy) were mixed with 100 ml of methanol in a shaker, and the thus wetted mixture was dispersed in 500 ml of water.

The resultant dispersion was treated in the same manner as in Example 6, to provide toners of 5–20 μm in particle size. The toner was found to have an electric charge of −13 μC./mg.

The toner formed electrophotographic images fixed on plain paper highly resolved and clear in tones together with nonimage area with no contamination. The fixed image was found to have a color darkness of 1.2 and mark 11 grade on a scale of 15 grades in tone presentation.

EXAMPLE 8

An amount of 50 g of the same styrene-acrylic acid ester copolymer particles as used in Example 2 and 1 g of the same silica powder as used in Example 2 was mixed with 100 ml of methanol in a shaker, and the thus wetted mixture was dispersed in 500 ml of water. Then the dispersion was added to an aqueous solution of 1.5 g of a red basic dye Aizen Rhodamine B (by Hodogaya Kagaku Kogyo K.K., Japan) in 500 ml of water.

The resultant dispersion was heated to 80° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and classified to particles of 5–20 μm in particle size. The toner was found to have an electric charge of −19 μC./mg.

The toner formed clear electrophotographic images fixed on plain paper with nonimage area with no contamination. the fixed image was found to have a color darkness of 1.0 and mark 8 grade on a scale of 15 grades in tone presentation.

EXAMPLE 9

An amount of 50 g of the same styrene-acrylic acid ester copolymer particles as used in Example 2, 1 g of the same silica powder as used in Example 2, 0.5 g of an yellow oil soluble dye Aizen SOT Yellow 1 (by Hodogaya Kagaku Kogyo K.K., Japan) and 0.75 g of a blue oil soluble dye Aizen SOT Blue 2 (by Hodogaya Kagaku Kogyo K.K., Japan) were mixed together with 100 ml of methanol in a shaker. The thus wetted mixture was dispersed in 500 ml of water.

The resultant dispersion was heated to 80° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and classified to particles of 5–20 μm in particle size. The toner was found to hve an electric charge of −23 μC./mg.

The toner formed electrophotographic images fixed on plain paper highly resolved and clear in tones together with nonimage area with no contamination. The fixed image was found to have a color darkness of 1.5 and mark 11 grade on scale of 15 grades in tone presentation.

EXAMPLE 10

An amount of 50 g of the same styrene-acrylic acid ester copolymer particles as used in Example 2, 1 g of the same silica powder as used in Example 2 and 1 g of a blue oil soluble dye Aizen SOT Blue 2 were mixed together with 100 ml of methanol in a shaker. The thus wetted mixture was then shaken for 10 min. in a shaker, and was added to 500 ml of water.

The resultant dispersion was heated to 85° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and then was classified to particles of 5–20 μm in particle size. The toner was found to have an electric charge of −33 μC./mg.

The toner formed electrophotographic images fixed on plain paper highly resolved and clear in tones together with nonimage area with no contamination. The fixed image was found to have a color darkness of 1.3 and mark 11 grade on a scale of 15 grades in tone presentation.

EXAMPLE 11

An amount of 50 g of the same styrene-acrylic acid ester copolymer particles as used in Example 2, 1 g of the same silica powder as used in Example 2 and 4 g of finely divided blue vat dye Nihonthrene Blue BC (by Sumitomo Kagaku Kogyo K.K., Japan) of average particle size of about 2 μm were mixed together with 100 ml of methanol, shaken for 10 min. with a shaker, and then was added to 500 ml of water.

The resultant dispersion was heated to 85° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, and classified to particles of 5–20 μm in particle size. The toner thus obtained was found to have an electric charge of −28 μC./mg.

The toner formed electrophotographic images fixed on plain paper highly resolved and clear in tones together with nonimage area with no contamination. The fixed image was found to have a color darkness of 1.1 and mark 11 grade on a scale of 15 grades in tone presentation.

EXAMPLE 12

An amount of 50 g of the same styrene-acrylic acid ester copolymer particles as used in Example 2 and 1 g of the same silica powder as used in Example 2 were mixed together with 100 ml of methanol, shaken for 10 min. with a shaker, and then was added to 500 ml of water containing blue vat dye Nihonthrene Blue BC.

The resultant dispersion was treated in the same manner as in Example 11, to provide toners of 5–20 μm in particle size. The toner formed electrophotographic images fixed on plain paper highly resolved and clear in tones together with nonimage area with no contamination. The fixed image was found to have a color darkness of 1.0 and mark 11 grade on a scale of 15 grades in tone presentation.

EXAMPLE 13

An amount of 50 g of polystyrene particles having a softening point of about 60° C. and an average particle size of about 10 μm and 1 g of the same silica powder as used in Example 2 were mixed together with 100 ml of methanol. The thus wetted mixture was added to an aqueous dispersion of 1.5 g of a red disperse dye Diacelliton Fast Scarlet B in 100 ml of water, and the resultant mixture was added to 500 ml of water.

The resultant dispersion was heated to 75° C. at a rate of 2° C./min. in a mixer with vigorous stirring, and was maintained at the temperature for 1 hour. After cooling, the resin particle was filtered with a No. 5 filter paper, washed with distilled water, dried at 40° C. under a reduced pressure for 24 hours, to provide toners of about 10 μm in average particle size. The toner was found to have an electric charge of −28 μC./mg.

Electrophotographic images were formed on a sheet of transparent polyester projecting film in the same manner as in Example 1. The image was found colored but transparent, as well as highly resolved and clear in tones together with nonimage area with no contamination.

What is claimed is:

1. A process for producing toners for use in electrophotography which comprises: dyeing resin particles which have a predetermined particle size with a dye in an aqueous medium in such amounts that the weight ratio of the medium to the resin particle is not less than about 5, in the presence of silica powder in an amount of up to 10% by weight based on the weight of the resin particles at temperatures of not less than the softening point of the resin but more than temperatures higher than the softening point by about 40° C. under vigorous stirring.

2. The process as claimed in claim 1, wherein the dye is a water-insoluble dye which is a disperse dye, a vat dye, a metal complexed dye or an oil-soluble dye.

3. The process as claimed in claim 1, wherein the dye is a water-soluble dye which is an acidic dye, a basic or cationic dye, a metal-complexed dye or a reactive dye.

4. The process as claimed in claim 1, wherein the resin particle and silica powder are mixed together with a small amount of an organic solvent to form a wetted mixture, and the wetted mixture is then added to the dyeing medium.

5. The process as claimed in claim 1, wherein the resin particle, silica powder and dye powder are mixed together with a small amount of an organic solvent to form a wetted mixture, and the wetted mixture is then added to the dyeing medium.

6. The process as claimed in claim 4, wherein the organic solvent is a lower aliphatic alcohol, a lower aliphatic carboxylic acid, a lower alkyl ester of a lower aliphatic carboxylic acid, an aliphatic or alicyclic ether, or a dialkyl ketone.

7. The process as claimed in claim 6, wherein the organic solvent is methanol.

8. The process as claimed in claim 1, wherein the resin particle is about 5–25 μm in particle size or average particle size.

9. The process as claimed in claim 1, wherein the dye is in advance finely divided to have a particle size or average particle size of not more than about 2 μm.

10. The process as claimed in claim 5, wherein the organic solvent is a lower aliphatic alcohol, a lower aliphatic carboxylic acid, a lower alkyl ester of a lower aliphatic carboxylic acid, an aliphatic or alicyclic ether, or a dialkyl ketone.

* * * * *